US011458057B2

(12) United States Patent
Obi

(10) Patent No.: US 11,458,057 B2
(45) Date of Patent: Oct. 4, 2022

(54) MEDICAL DEVICE

(71) Applicant: MIZUHO Corporation, Tokyo (JP)

(72) Inventor: Takuya Obi, Sakura (JP)

(73) Assignee: MIZUHO Corporation, Tokyo (JP)

( * ) Notice: Subject to any disclaimer, the term of this patent is extended or adjusted under 35 U.S.C. 154(b) by 507 days.

(21) Appl. No.: 16/488,648

(22) PCT Filed: Feb. 27, 2017

(86) PCT No.: PCT/JP2017/007346
§ 371 (c)(1),
(2) Date: Aug. 26, 2019

(87) PCT Pub. No.: WO2018/154751
PCT Pub. Date: Aug. 30, 2018

(65) Prior Publication Data

US 2019/0374419 A1 Dec. 12, 2019

(51) Int. Cl.

| | |
|---|---|
| ***A61G 13/00*** | (2006.01) |
| ***A61G 13/08*** | (2006.01) |
| ***A61G 13/10*** | (2006.01) |
| ***A61G 13/12*** | (2006.01) |

(52) U.S. Cl.
CPC ..... *A61G 13/0036* (2013.01); *A61G 13/08* (2013.01); *A61G 13/129* (2013.01); *A61G 13/101* (2013.01)

(58) Field of Classification Search
CPC .. A61G 13/0036; A61G 13/08; A61G 13/129; A61G 13/101; A61G 7/10; A61G 7/1025; A61G 7/1026; A61G 7/103; A61G 7/1032; A61G 7/1034; A61G 13/02; A47C 20/16; A47C 20/18
See application file for complete search history.

(56) References Cited

FOREIGN PATENT DOCUMENTS

| | | | | |
|---|---|---|---|---|
| JP | 62-208847 A | | 9/1987 | |
| JP | 08-168508 A | | 7/1996 | |
| JP | 10-279045 A | | 10/1998 | |
| JP | 10279045 | * | 10/1998 | ..... B65G 35/06 |
| JP | 2003-505201 A | | 2/2003 | |
| JP | 2003-505201 A5 | | 10/2008 | |
| WO | WO-0108621 A2 | * | 2/2001 | ..... A61B 6/0457 |
| WO | 2010/150482 A1 | | 12/2010 | |

OTHER PUBLICATIONS

International Search Report of PCT/JP2017/007346 dated Mar. 28, 2017 [PCT/ISA/210].

* cited by examiner

*Primary Examiner* — David R Hare
*Assistant Examiner* — Madison Emanski
(74) *Attorney, Agent, or Firm* — Sughrue Mion, PLLC

(57) ABSTRACT

A surgical operation table capable of operating a table with a large slide width without a slide mechanism interfering with other members in a slide operation of the table is provided. A surgical operation table S including a table 10 movable in a horizontal direction to a base 2 includes a slide mechanism 20 that moves the table 10 in the horizontal direction, and the slide mechanism 20 includes a rack 21*a* extending in a longitudinal direction of the table 10, a driving gear 26, a driven gear 27 and an idler gear 28 that are meshed with the rack 21*a* and rotate integrally, and an actuator 23 that supplies a rotational driving force to at least one of the gears 26 to 28.

6 Claims, 8 Drawing Sheets

MEDICAL DEVICE

CROSS REFERENCE TO RELATED APPLICATIONS

This application is a National Stage of International Application No. PCT/JP2017/007346, filed Feb. 27, 2017.

TECHNICAL FIELD

The present invention relates to medical device, and particularly relates to a slide device of a table of a surgical operation table.

BACKGROUND ART

A surgical operation table is generally equipped with a slide device that can slide a table on which a patient is laid in a horizontal direction, because the surgical operation table needs to move a specific part of the patient to a position where a doctor easily treats the specific part of the patient (refer to Patent Literature 1).

For example, the surgical operation table shown in Patent Literature 1 includes a slide device capable of sliding the table in a longitudinal direction, and the slide device performs a slide operation of the table by fixing a rack to a table side and rotating a pinion that is meshed with the rack forward or backward by a motor.

Further, in the surgical operation table already carried out by the applicant, the slide device is disposed below an outside of the table.

CITATION LIST

Patent Literature

Patent Literature 1: Japanese Patent Laid-Open No. 8-168508

DISCLOSURE OF INVENTION

Technical Problem

Incidentally, in the mode of performing a slide operation by using a rack and a pinion, it is difficult to increase a slide amount of the table when the rack cannot be disposed to be long (increase in size) due to various restraints.

Further, when the slide operation is performed by using the rack and the pinion, a problem concerning strength easily occurs, it is difficult to slide the rack to the maximum, and the slide operation is usually set to be performed with a stroke shorter than the length of the rack.

Further, when the slide device is disposed outside the table, the slide device interferes with the column and the base of the surgical operation table when the table is slid while a large angle of lengthwise turning or crosswise turning is taken.

Thus, in order to solve an example of the problem like this, the present application has a first object to provide medical device capable of operating a table with a large slide width in a slide operation of the table. Further, the present application has a second object to provide medical device where a slide mechanism does not interfere with other members.

Solution to Problem

In order to solve the above described problem, medical device (S) according to claim 1 is medical device including a table (10) movable in a horizontal direction to a base (2), and includes a moving unit (20) that moves the table in the horizontal direction, wherein the moving unit includes a guide unit (21*a*) that extends in a longitudinal direction of the table, and defines a moving direction of the table, a plurality of rotating bodies (26, 27, 28) that contact the guide unit, and rotate integrally, and a driving unit (23) that supplies a rotational driving force to at least one of the rotating bodies.

Further, the medical device according to claim 2 is the medical device according to claim 1, wherein the moving unit is disposed inside the table.

Further, the medical device according to claim 3 is the medical device according to claim 1 or 2, wherein the plurality of gears are set to satisfy a restraint meshing condition.

Further, the medical device according to claim 4 is the medical device according to claim 1 or 2, wherein the plurality of gears are connected by a chain.

The medical device according to claim 5 is the medical device according to any one of claims 1 to 4, wherein the driving unit includes a shaft including a driving force transmission mechanism that transmits a driving force to all the gears, and a drive body that supplies a driving force to the shaft.

Advantageous Effects of Invention

The slide amount of the table can be increased while increase in size of the slide mechanism and increase in installation space are prevented. Further, the slide mechanism is disposed inside, so that even when the table is caused to perform a slide operation while the table is tilted, the slide mechanism does not interfere with other members.

DESCRIPTION OF EMBODIMENT

Hereinafter, a mode for carrying out the present invention will be described based on an embodiment of the present invention illustrated in the accompanying drawings. Note that in the following explanation, an idler gear refers to a gear for connecting gears that are meshed with an input rack and an output rack. Further, a surgical operation table of the present embodiment also includes a medical examination table, a treatment table and the like for different use purposes. It is also possible to apply a slide mechanism that is used in the surgical operation table of the present embodiment to various kinds of medical device for use in a medical field.

Figure 1:
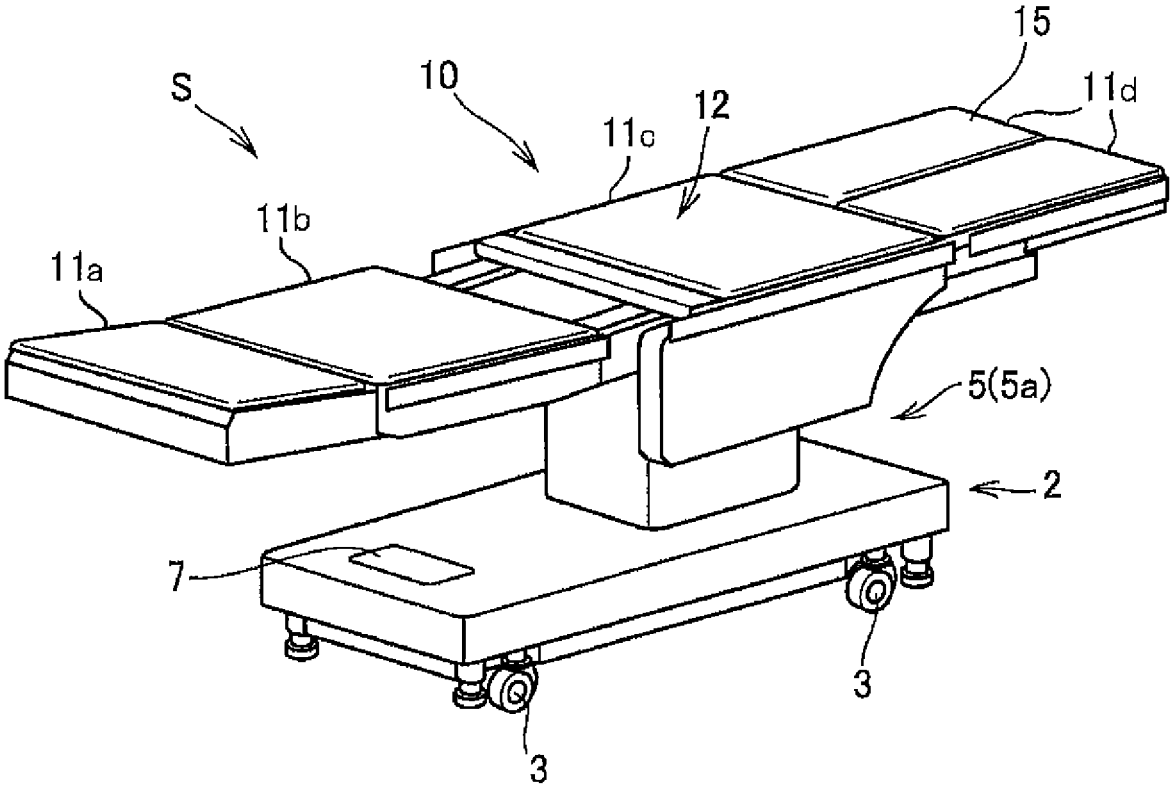
FIG. 1 is a schematic view illustrating a configuration example of a surgical operation table.

As illustrated in FIG. 1, a surgical operation table S includes a base 2 that is placed on a floor of a surgical operation room, a column 5 that is raised on the base 2, and a table 10 that is mounted on the column 5.

At a lower side of the base 2, casters 3 are attached, and it is possible to move the surgical operation table S freely on the floor surface of the surgical operation room by the casters 3. Note that the casters 3 are not essential components, but are provided in accordance with necessity.

Further, inside the base 2, for example, a control device that functions as a control section for electrically controlling an operation of the surgical operation table S, and the like are housed, and on a surface of an upper portion of a rear side, a touch panel type display body 7 for operating the surgical operation table S is provided.

The column 5 includes a plurality of rods (not illustrated) which are combined to be extensible and contractible in the vertical direction on the base 2, hydraulic cylinder devices (not illustrated) that extend and contract the rods, and a cover 5*a* that is extensible and contractible in a telescopic manner that encloses the rods, the hydraulic cylinder devices and the like. The rods extend and contract by drive of the hydraulic cylinder devices, whereby the column 5 changes a height in the vertical direction, and the table 10 is adjusted to a predetermined height.

The table 10 is for placing a patient, and includes frame bodies 11*a* to 11*d* that are divided respectively into a head portion, a back portion, a hip portion and a leg portion, for example, as illustrated in FIG. 1. The frame bodies 11*a* to 11*d* have mattress 12 formed of mat or cushion having a predetermined thickness attached thereto and are used as a bed, and has such a size that a patient can be laid thereon. The respective frame bodies 11*a* to 11*d* are connected by being coupled with pins to be bendable though not illustrated, are respectively configured to be turnable in the vertical direction, and can be locked in a predetermined positional relationship by a lock device not illustrated.

In this way, the table 10 of the present embodiment is configured into a divided shape capable of changing a posture of the patient by turning (bending) the respective frame bodies 11*a* to 11*d* as illustrated in FIG. 1, but these respective frame bodies 11*a* to 11*d* are configured to be attachable and detachable, and it is also possible to replace the respective frame bodies 11*a* to 11*d* with one plate-shaped member in accordance with contents of a surgical operation and treatment.

Figure 2:
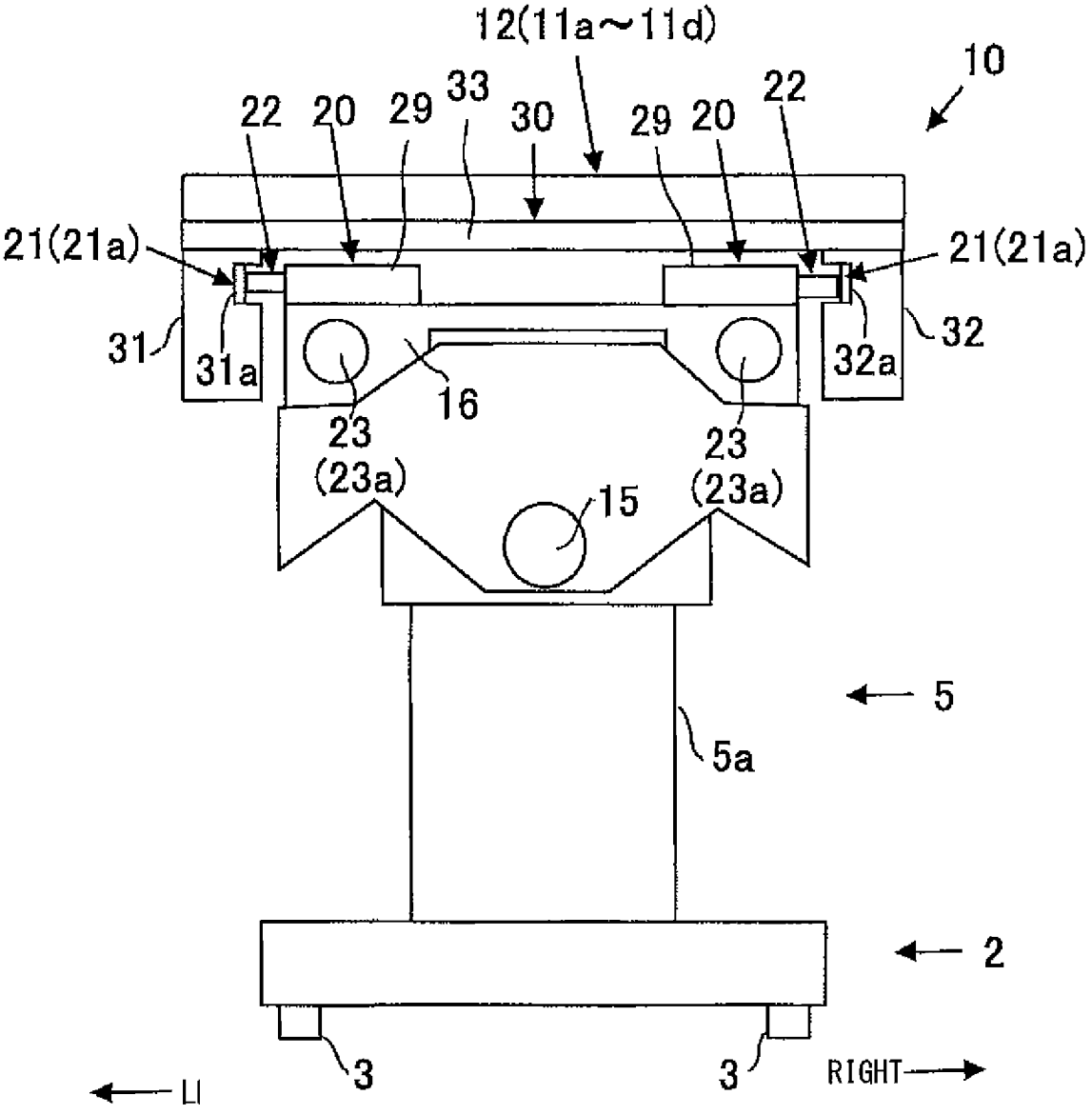
FIG. 2 is a schematic view illustrating a configuration example of a slide mechanism.

Further, the table 10 is connected onto the column 5 via a gimbal mechanism (not illustrated), and on the column 5, by the gimbal mechanism, it is possible to turn the table 10 crosswise at a predetermined angle to a desired orientation via a pivot 15 illustrated in FIG. 2, for example. The gimbal mechanism is already known to the public, so that explanation thereof will be omitted. Note that the surgical operation table of the present embodiment is turnable lengthwise by a predetermined gimbal mechanism not illustrated.

Figure 3A:
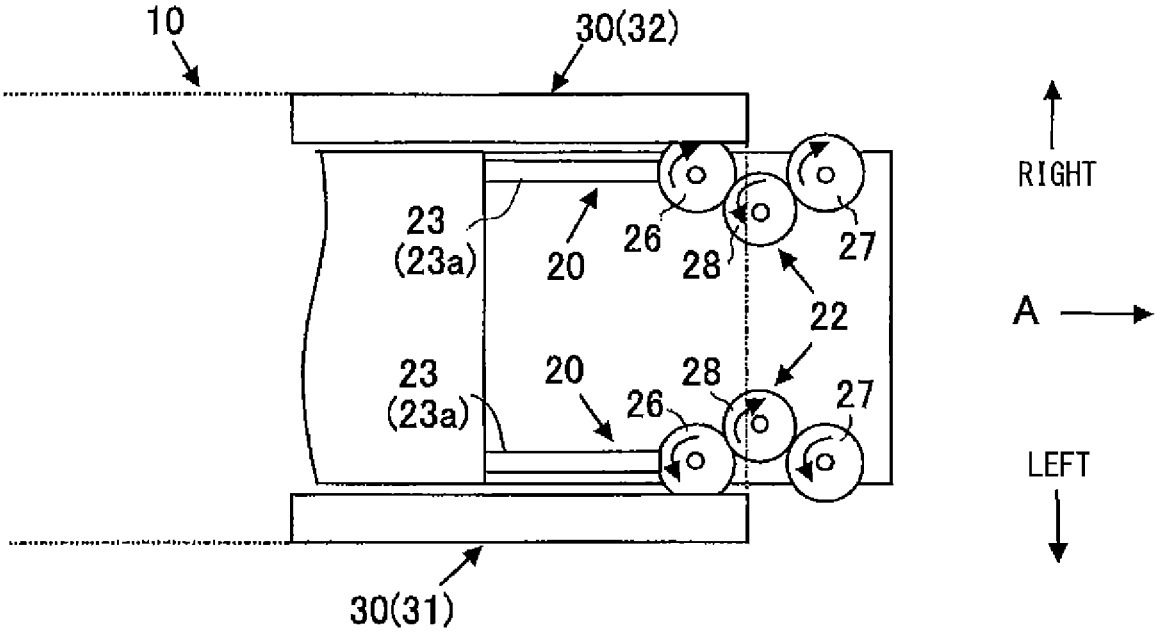
FIGS. 3A and 3B are schematic views illustrating an operation example of the slide mechanism.
Figure 3B:
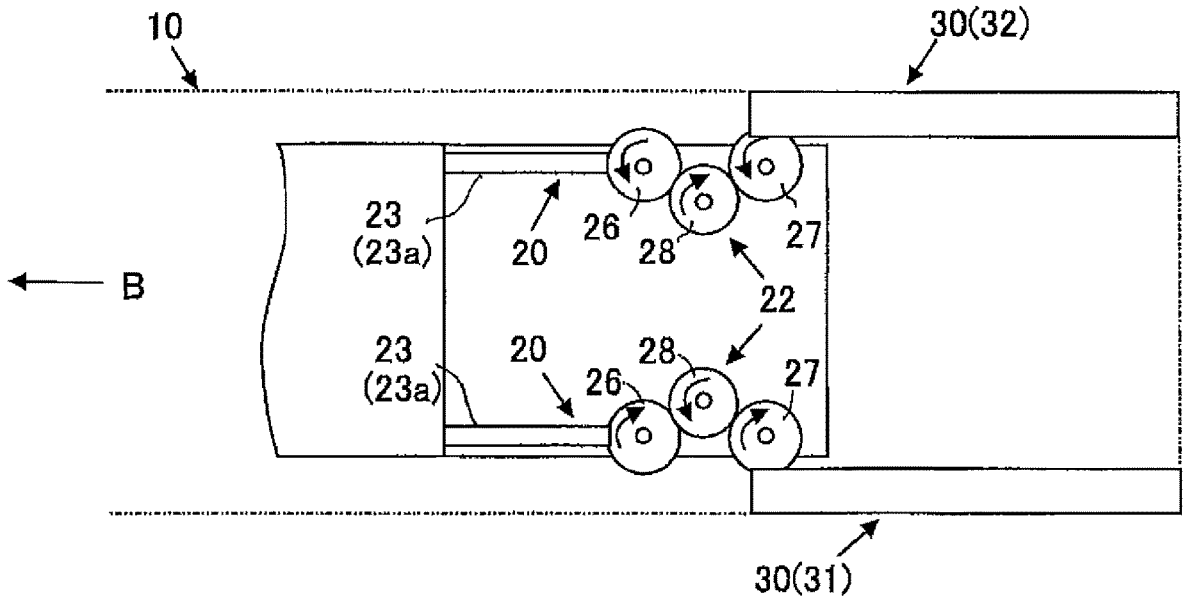

Further, as illustrated in FIG. 2 and FIGS. 3A and 3B, the table 10 of the surgical operation table S of the present embodiment is mounted above the column 5 via a slide mechanism 20. The table 10 is formed into a substantially rectangular shape, and is slidable in a longitudinal direction (an A-direction or a B-direction) by the slide mechanism 20.

As illustrated in FIG. 2, the table 10 includes a slider 30 that is mounted on a frame 16 that is disposed above the column 5 via the slide mechanism 20, and on the slider 30, the frame bodies 11*a* to 11*d* provided with the mattress 12 for supporting the patient are disposed.

The slider 30 includes left and right casings 31 and 32 provided to hang down at both sides of the frame 16, and a connection body 33 that connects the casings 31 and 32. The respective casings 31 and 32 are formed to extend along a longitudinal direction of the table 10, and a hydraulic cylinder device (not illustrated) for bending respective portions of the table 10 at joints and the like are housed in the casings 31 and 32.

The slide mechanism 20 (a moving unit of the present application) is attached along the A, or the B direction of the slider 30, and includes a guide section 21 (a guide unit of the present application) that defines a slide direction, a plurality of rotating bodies 22 that contact the guide section 21, and an actuator 23 (a driving unit of the present application) that rotationally drives the rotating bodies 22.

As an example of the guide section 21, a rack (hereinafter, referred to as an "output rack 21*a*") is used. The output rack 21*a* is provided in recessed portions 31*a* and 32*a* that are formed in inner side surfaces of the casings 31 and 32 to extend linearly along the longitudinal direction 10.

Figure 4:
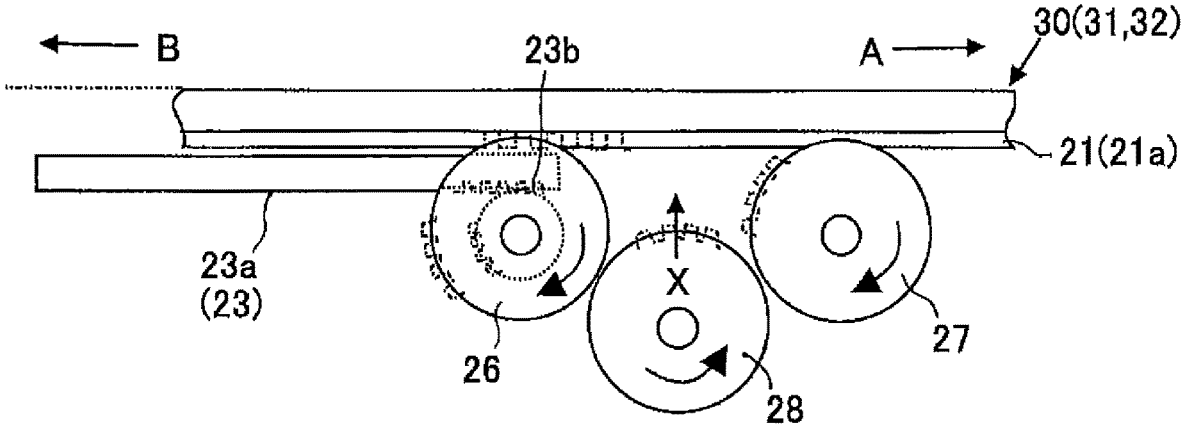
FIG. 4 is a schematic view illustrating a disposition example of the slide mechanism.

As an example of the rotating body 22, a gear mechanism is used. As illustrated in FIGS. 3A and 3B and FIG. 4, the gear mechanism is configured by a gear train including, for example, a driving gear 26 that receives a driving force from the actuator 23, a driven gear 27 that transmits the driving force to the output rack 21*a*, an idler gear 28 that connects the driving gear 26 and the driven gear 27, and the idler gear 28 and the driven gear 27 are restrained by rotation of the driving gear 26.

As illustrated in FIG. 2, the gear mechanisms are housed in cover members 29 that are attached to both left and right sides of a top surface of the frame 16, and the respective gears 26 to 28 are rotatably supported axially by the cover members 29.

Further, the gear train is disposed to satisfy a restrain meshing condition, as illustrated in FIG. 4, for example, the driving gear 26 and the driven gear 27 are meshed with the output rack 21*a*, the idler gear 28 is disposed to be meshed with the driving gear 26 and the driven gear 27, and the idler gear 28 is disposed to be meshed with the driving gear 26 and the driven gear 27 by being pushed in an arrow X direction.

As an example of the actuator 23, a cylinder device 23*a* is used. For the cylinder device 23*a*, for example, a double-acting type hydraulic cylinder unit is used, and the cylinder unit is disposed to extensively and contractively drive along the longitudinal direction of the table 10.

The cylinder device 23*a* includes a main body that has a chamber interior which is formed to be hollow and has the chamber interior partitioned into a bottom chamber and a rod chamber by a piston, and a piston rod that is attached to the piston disposed in the main body to be slidable in an axial direction thereof. The cylinder device 23*a* generates a driving force for extending and contracting the piston rod by working oil that is fed from a hydraulic pressure generating unit not illustrated.

The main body of the cylinder device 23*a* is attached to the frame 16, for example, as illustrated in FIG. 2, and a rack (hereinafter, an "input rack 23*b*") as a driving force transmission mechanism for transmitting the driving force is attached to a tip end of the piston rod and is connected to the driving gears 26 and 27, as illustrated in FIG. 4.

Note that the gear train may be configured by more gears (driving gears and idler gears) being connected. Further, the actuator 23 may be connected to the gears 26 to 28 configuring the gear train by using the motor having an input shaft, and by attaching a worm gear and a worm wheel as the driving force transmission mechanism to the input shaft.

Further, the input rack 23*b* may be connected to the idler gear 28. That is, the input rack 23*b* can be connected to at least one of the gear trains that configure the gear mechanism.

Further, as illustrated in FIG. 4, in the present embodiment, the driving gear 26 is configured by providing and superimposing a gear with a large diameter and a large number of teeth on a gear with a small diameter, and the input rack 23*b* is connected to the gear with a small diameter. In this way, the entire gear can be formed to be compact by configuring the gears at different stages.

The slide mechanism 20 configured in this way extends and contracts the piston rod by drive of the actuator 23, and when the driving force is transmitted to the driving gear 26 by the input rack 23*b*, the driving force is transmitted to the driven gear 27 via the idler gear 28, and for example, when the table 10 is moved in the A-direction, and the driving gears 26 and 27 are in positions illustrated in FIG. 4, the driving force is transmitted to the output rack 21*a* via the driving gear 26 and the driven gear 27. In this way, the output rack 21*a* is supported by the gear train to satisfy the restraint meshing condition, and therefore is supported sufficiently stably in terms of strength.

Further, as illustrated in FIG. 3B, the slider 30 is supported by the driven gear 27 while being meshed with the driven gear 27 even after the slider 30 is released from meshing with the driving gear 26, so that even when the output rack 21*a* cannot be disposed to be long, it is possible to increase a slide amount of the table 10 beyond the length of the output rack 21*a*, with a simple structure.

Further, the driving gear 26 and the driven gear 27 rotate while being pushed to the X-direction by the idler gear 28, and are meshed with the output rack 21*a*, so that reduction in backlash is achieved with the simple structure.

Note that in the present embodiment, the slide mechanisms are disposed at both the left and right sides and drive sources such as motors are operated synchronously, but the slide mechanism may be disposed on only one side, and the other side may be configured by a guide member (for example, a rack and a pinion, or the like) that does not use a drive source.

Next, an example of the slide operation of the table of the surgical operation table will be described with use of FIGS. 3A and 3B and FIG. 4. Note that in the left and right slide mechanisms 20, the slide operation of the table is performed by rotating the mutual gears oppositely, so that in the following explanation, an operation of the slide mechanism on the right side (refer to FIG. 4) will be described.

First, in FIG. 3A, when the actuator 23 is caused to perform an extension operation, the piston rod is moved in the A-direction, and the driving gear 26 is rotated clockwise, the driving force transmitted to the driving gear 26 from the actuator 23 is transmitted to the driven gear 27 via the idler gear 28, and the driven gear 27 rotates clockwise similarly to the driving gear 26. When the driving force of the actuator 23 is transmitted to the output rack 21*a* by the operation like this, the table 10 moves in the A-direction.

Further, as illustrated in FIG. 4, by further movement in the A-direction of the table 10, the output rack 21*a* are meshed with the driving gear 26 and the driven gear 27, and the driving force is transmitted to the output rack 21*a* via the driving gear 26 and the driven gear 27. Accordingly, the table 10 is supported sufficiently stably in terms of strength by the driving gear 26 and the driven gear 27, in a vicinity of an end portion of the table 10.

Further, as illustrated in FIG. 3B, by further movement in the A-direction of the table 10, the output rack 21*a* is released from the driving gear 26 but is meshed with the driven gear 27, so that the driving force is transmitted to the output rack 21*a* via the driven gear 27. Accordingly, it is possible to increase the slide amount of the table with the simple structure.

When the driving gear 26 is rotated counterclockwise by a contraction operation of the actuator 23, a driving force that is transmitted to the driving gear 26 from the actuator 23 is transmitted to the driven gear 27 via the idler gear 28, and the driven gear 27 rotates counterclockwise similarly to the driving gear 26. When the driving force of the actuator 23 is transmitted to the output rack 21*a* by the operation like this, the table 10 moves in the B-direction.

In this way, the surgical operation table S of the present embodiment is the surgical operation table S including the table 10 which is movable in the horizontal direction with respect to the base 2, and includes the slide mechanism 20 that moves the table 10 in the horizontal direction. The slide mechanism 20 includes the output rack 21*a* that extends in the longitudinal direction inside of the table 10, the driving gear 26 and the driven gear 27 that are meshed with the output rack 21*a* and rotate integrally, the idler gear 28, and the actuator 23 that supplies the rotational driving force to at least one of the gears 26 to 28. The driving gear 26, the driven gear 27 and the idler gear 28 are disposed to satisfy the restraint meshing condition.

Even if one of the gears 26 and 27 is removed from the output rack 21*a* in a slide process of the table 10, the output rack 21*a* is supported by the other of the gears 27 and 26, so that the slide operation of the table 10 is possible.

Accordingly, even when the output rack 21*a* cannot be disposed to be long, it is possible to increase the slide amount of the table 10 beyond the length of the output rack 21*a*.

Next, other examples of the slide mechanism will be described.

First Example

Figure 5:
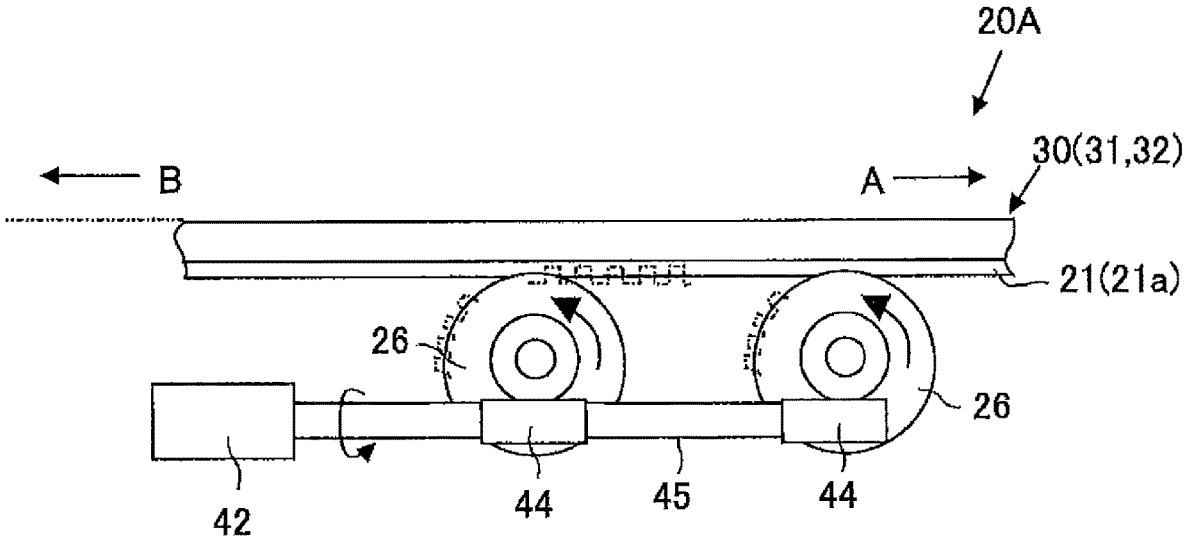
FIG. 5 is a schematic view illustrating another example of the slide mechanism.

A first embodiment of the slide mechanism will be described with use of FIG. 5. Note that in the slide mechanism in FIG. 5, components that are functionally common to the slide mechanism 20 illustrated in FIG. 1 to FIG. 4 are assigned with the same reference signs, and explanation thereof will be omitted.

A gear mechanism included in a slide mechanism 20A of the present embodiment is configured by a plurality of gears, but differs from the gear mechanism of the embodiment illustrated in FIG. 1 to FIG. 4 described above in that the gears are not connected by the idler gear 28.

Specifically, the gear mechanism of the present embodiment is configured by the two driving gears 26 and 26 that receive the driving force simultaneously from the actuator 23, and the two driving gears 26 and 26 are rotatably supported axially by the cover member 29 with predetermined spacing in the longitudinal direction of the table 10. Further, worm wheels with small diameters are provided in the two driving gears 26 and 26, and are connected to worm wheels 44 of the actuator.

For the actuator 23, for example, a motor 42 having a rotating shaft (not illustrated) is used, and an input shaft 45 including the two worm wheels 44 and 44 (worm gears) which are disposed with predetermined spacing is attached to the rotating shaft, and the respective worm wheels 44 and 44 are connected to the worm wheels of the respective driving gears 26 and 26.

In the slide mechanism 20A configured in this way, a rotational driving force is transmitted to the respective driving gears 26 and 26 via the worm wheels 44 and 44 by drive of the motor 42, the driving force is transmitted to the output rack 21*a* via the respective driving gears 26 and 26, and the output rack 21*a* moves in the A-direction. Note that in the slide mechanism 20A of the present embodiment, even when the driving gear 26 on one side is removed from the output rack 21*a* in the slide process of the table 10, the output rack 21*a* is supported by the other gear 26, so that the slide operation of the table 10 is possible.

In this way, the slide mechanism 20A of the present embodiment includes the two driving gears 26 and 26 which receive the driving force simultaneously from the actuator 23, and are disposed with the predetermined spacing, and the respective driving gears 26 and 26 are disposed by being meshed with the output rack 21*a*. Accordingly, even when the output rack 21*a* cannot be disposed to be long, it is possible to increase the slide amount of the table 10 beyond the length of the output rack 21*a*.

Second Example

Figure 6A:
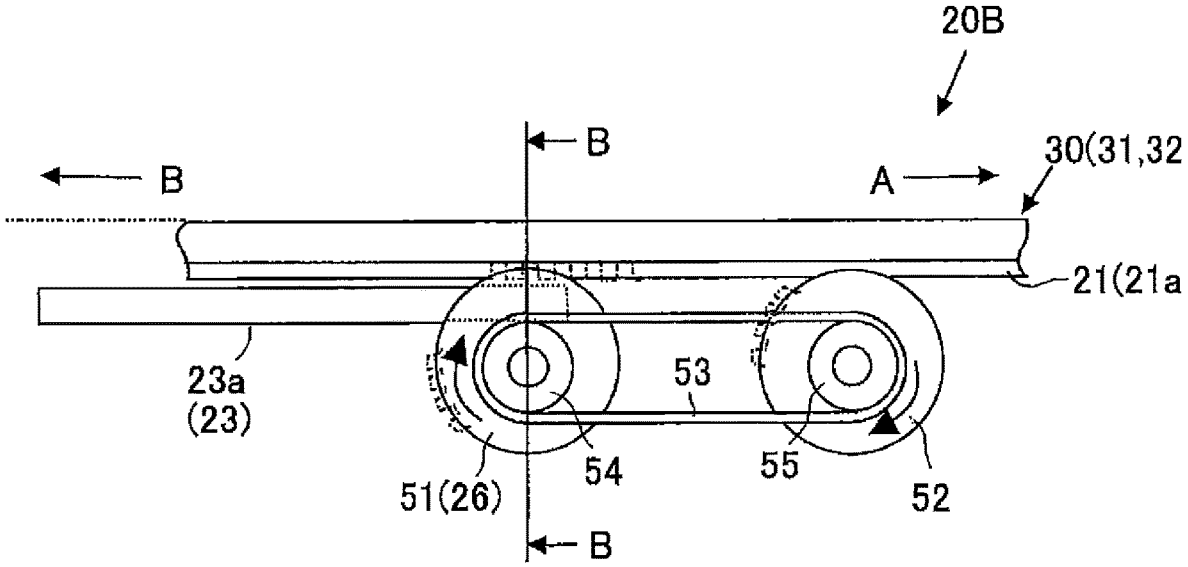
FIGS. 6A and 6B are schematic views illustrating another example of the slide mechanism.
Figure 6B:
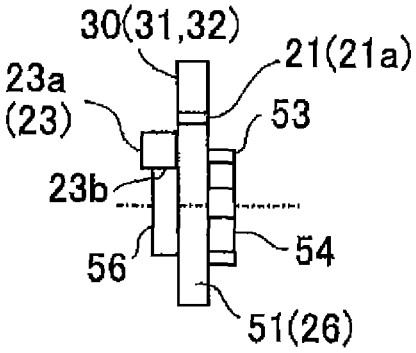

With use of FIGS. 6A and 6B, a second embodiment of the slide mechanism will be described. Note that FIG. 6B is a sectional view taken along B-B in FIG. 6A. Further, in a slide mechanism 20B in FIGS. 6A and 6B, components common to the slide mechanism 20 illustrated in FIG. 1 to FIG. 4 are assigned with the same reference signs, and explanation thereof will be omitted.

A gear mechanism included in a slide mechanism 20B of the present embodiment is configured by a plurality of gears, but differs from the gear mechanism of the embodiment illustrated in FIG. 1 to FIG. 4 described above in that the plurality of gears are not connected by the idler gear 28.

Specifically, the gear mechanism of the present embodiment is configured by two gears 51 and 52 that simultaneously receive a driving force from the actuator 23, the two gears 51 and 52 are configured by providing and superimposing gear bodies with large diameters and a large number of gears on gear bodies 54 and 55 with small diameters, and the gear bodies 54 and 55 with small diameters are connected by a chain 53.

Further, the gear 51 on one side functions as the driving gear 26, and is configured by providing and superimposing another gear body 56 on a back surface of the driving gear 26, and the input rack 23*b* of the actuator 23 is connected to the other gear body 56 by being meshed with the other gear body 56. Further, the two gears 51 and 52 are rotatably supported axially by the cover member 29 with predetermined spacing in the longitudinal direction of the table 10.

In the slide mechanism 20B configured in this way, when the piston rod is extended and contracted by drive of the actuator 23, and the driving force is transmitted to the gear 51 by the input rack 23*b*, the driving force is transmitted to the gear 52 via the chain 53, the driving forces are transmitted to the output rack 21*a* simultaneously via the two gears 51 and 52, and the output rack 21*a* moves in the A-direction while being supported by the two gears 51 and 52. Note that in the slide mechanism 20B of the present embodiment, even when the gear 51 at one side is removed from the output rack 21*a* in the slide process of the table 10, the output rack 21*a* is supported by the gear 52 at the other side, so that the slide operation of the table 10 is possible.

In this way, the slide mechanism 20B of the present embodiment includes the two gears 51 and 52 which are connected by the chain 53 with the predetermined spacing, and the gears 51 and 52 are disposed by being meshed with the output rack 21*a*. Accordingly, even when the output rack 21*a* cannot be disposed to be long, it is possible to increase the slide amount of the table 10 beyond the length of the output rack 21*a*.

Note that the present embodiment is one mode, and the present invention is not limited to the mode. For example, the slide mechanisms 20, 20A and 20B of the present embodiment are disposed on the frame 16, but the slide mechanisms 20, 20A and 20B are not limited to this mode, but may be disposed by being arbitrarily changed in accordance with the structure of the surgical operation table S, and may be disposed on the side surface or the like of the frame 16 of the surgical operation table S, for example.

REFERENCE SIGNS LIST

S Surgical operation table
2 Base
5 Column
10 Table
20 Slide mechanism
21*a* Output rack
23 Actuator
26 Driving gear
27 Driven gear
28 Idler gear

The invention claimed is:

1. A medical device including a table movable in a horizontal direction relative to a base, the medical device comprising:
- a moving unit configured to move the table in the horizontal direction,
- wherein the moving unit includes:
  - a guide unit that extends in a longitudinal direction of the table, and defines a moving direction of the table;
  - a gear train including:
    - a driving gear configured to mesh with the guide unit;
    - a driven gear configured to transmit a driving force from the driving gear to the guide unit; and
    - an idler gear that connects the driving gear and the driven gear;
    - wherein the driving gear, the driven gear and the idler gear are configured to rotate integrally; and
  - a driving unit configured to supply the driving force to the driving gear,
- wherein a rotation axis of the idler gear and the guide unit are positioned apart on different sides of a reference line connecting rotation axes of the driving gear and the driven gear.

2. The medical device according to claim 1, wherein the moving unit is disposed inside the table,
- wherein two guide units extend in the longitudinal direction on both left and right sides,
- wherein the gear train is disposed between the two guide units and on an inner side of one of the two guide units, and
- wherein a second gear train is disposed between the two guide units and on an inner side of the other one of the two guide units.

3. The medical device according to claim 1, wherein the gear train is set to satisfy a restraint meshing condition.

4. The medical device according to claim 2, wherein the gear train is set to satisfy a restraint meshing condition.

5. The medical device according to claim 3, wherein the driving gear and the driven gear are configured to rotate while being pushed to a direction perpendicular to the longitudinal direction of the table by the idler gear.

6. The medical device according to claim 4, wherein the driving gear and the driven gear are configured to rotate while being pushed to a direction perpendicular to the longitudinal direction of the table by the idler gear.

* * * * *